United States Patent [19]

Kimura et al.

[11] Patent Number: 4,993,437

[45] Date of Patent: Feb. 19, 1991

[54] HAIR COSMETICS COATING TOOL

[75] Inventors: Masaru Kimura, Shinmachi; Kiyokazu Sakurai, Kamiizumimura, both of Japan

[73] Assignee: Mitsubishi Pencil Co., Ltd., Tokyo, Japan

[21] Appl. No.: 496,152

[22] Filed: Mar. 19, 1990

Related U.S. Application Data

[63] Continuation of Ser. No. 364,544, Jun. 7, 1989, abandoned, which is a continuation of Ser. No. 135,411, Dec. 21, 1987, abandoned.

[30] Foreign Application Priority Data

Dec. 9, 1986 [JP] Japan ..... 61-189637

[51] Int. Cl.[5] ..... A45D 24/22; A45D 24/16

[52] U.S. Cl. ..... 132/112; 132/116; 132/120; 401/273; 401/278; 401/287; 401/291

[58] Field of Search ..... 401/270, 273, 278, 282, 401/286, 287, 288, 289, 290, 291; 132/112, 116, 120

[56] References Cited

U.S. PATENT DOCUMENTS

| | | | |
|---|---|---|---|
| 711,544 | 10/1902 | Tesch | 401/282 X |
| 2,672,875 | 3/1954 | Kovacs | 132/112 |

FOREIGN PATENT DOCUMENTS

| | | | |
|---|---|---|---|
| 907 | of 1900 | United Kingdom | 401/287 |
| 879577 | 10/1961 | United Kingdom | 132/116 |
| 2172797 | 10/1986 | United Kingdom | 401/273 |

*Primary Examiner*—Steven A. Bratlie

*Attorney, Agent, or Firm*—Armstrong, Nikaido, Marmelstein, Kubovcik & Murray

[57] ABSTRACT

A hair cosmetics coating tool comprising a main cylindrical body, a storage part of a liquid hair cosmetic provided in said main cylindrical body, a brush provided at the top of the main cylindrical body, small holes for supplying the liquid hair cosmetics from the storage part to the brush and a comb body provided adjacent to the brush, while bristle root holes of the brush and the small holes being communicated with each other totally through slits.

4 Claims, 2 Drawing Sheets

HAIR COSMETICS COATING TOOL

This application is a continuation of application Ser. No. 364,544, filed on June 7, 1989, which is a continuation of U.S. Ser. No. 135,411, filed Dec. 21, 1987 both now abandoned.

BACKGROUND OF THE INVENTION

1. Field of the Invention

The present invention relates to a hair cosmetics coating tool and, more particularly, a coating tool for hair coloring gent, hair dyeing agent, hair bleach agent, hair setting agent, permanent wave agent, hair treatment agent and other hair cosmetics.

2. Prior Art

For example, when hair is dyes with a temporary hair dyeing agent known in the prior art such as a mass color type, a brush etc. must be dipped into the hair dyeing agent held in a vessel every time prior to applying it to the hair, requiring extremely tedious work. In addition, when the brush, etc. is pulled out of the vessel, the brush can touch the mouthpiece of the vessel possibly splashing the dyeing agent.

Such disadvantages also occur with a tool for coating a hair bleach agent, permanent or semi-permanent dyeing agent, hair setting agent, permanent wave agent, hair treatments agent and other hair cosmetics.

In order to solve such problems, a handy hair dyeing tool has been proposed in the prior art, in which a storage part for a liquid hair dyeing agent is provided in a main body while supplying the liquid hair dyeing agent to a brush from the storage part. However, the rate of supplying the liquid hair dyeing agent may often become excessively small even where supply holes of the liquid hair dyeing agent are provided in addition to bristle root holes of the brush.

A present invention provides a hair cosmetics coating tool for a temporary hair dyeing agent, permanent or semi-permanent hair dyeing agent, hair bleach agent, hair setting agent, permanent wave agent or a hair treatment agent, etc. An object of the present invention is to submit a handy hair cosmetics coating tool operable like a pen gripped in the hand of a user, having a novel structure where a brush, etc. need not be dipped in the hair cosmetics stored in a vessel. Such structure providing extremely excellent operability while supplying the hair cosmetics to the rush, etc. always at a sufficient rate would cause fewer troubles in performing such coating work.

SUMMARY OF THE INVENTION

The present invention provides a hair cosmetics coating tool comprising a main cylindrical body, a storage part of a liquid hair cosmetics located in said main cylindrical body, a brush rooted in bristle root holes provided at the top of the main cylindrical body, small holes for supplying the liquid hair cosmetics from said storage part to the brush and a comb body provided adjacent to said brush. The bristle root holes and the small holes are communicated to the storage part and the bristle root holes and the small holes are communicated with each other by means of slits.

It is more preferable to provide a valve device additionally for controlling the supply of the liquid hair cosmetics to the brush.

The storage part of said liquid hair cosmetics may comprise a detachable cartridge.

The comb body is preferably provided detachably.

DETAILED DESCRIPTION AND THE PREFERRED EMBODIMENTS OF THE INVENTION

Figure 1:
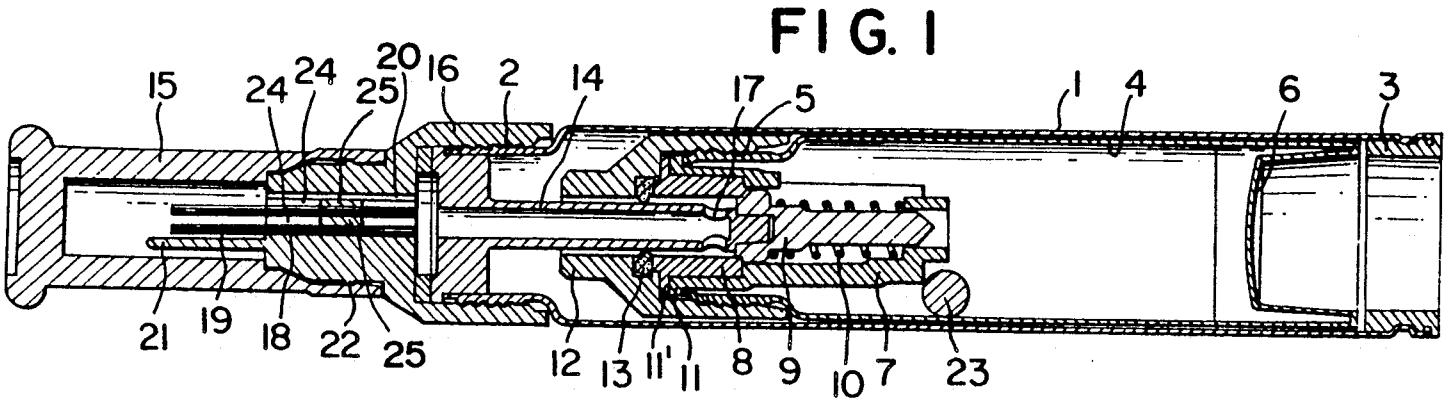
FIG. 1 shows a longitudinal section at the center of a hair dyeing tool according to the present invention.

The present invention is detailed in the following referring to embodiments of the pen type hair dyeing tools according to the invention. However, the invention is not limited thereby.

Referring to the drawings, 1 shows a cylindrical shaft with both ends opened. At the front end, the diameter is made slightly smaller and cut with male threads 2. At the rear open end, a cylindrical tail plug 3 is fixed with its center part opened.

Number 4 shows a cartridge type storage tank of hair dyeing liquid, which is mounted in a free moving manner in longitudinal direction inside the cylindrical shaft 1. This cartridge type storage tank 4 is detachable. This storage tank 4 is provided with an open front end and a closed rear end, in the same structure as conventional cartridge type tanks. The diameter of the front end is made slightly small, where male threads 5 are machined at a part of smaller diameter. At the rear end, a recess 6 is formed. Inside the front open end of the storage tank 4, there is a valve device comprising a spring seat 7, valve seat 8, valve stem 9 and a valve spring 10. With this embodiment, a valve device is used for controlling the supply of a hair dyeing liquid. However, a differently structured means may be used or the coating tool may not be provided with a valve.

A fixed member 12 is screwed in the male part 5 of the storage tank 4. The spring seat 7 and the flange parts 11,11' of the valve seat 8 are sandwiched between a stepped part of the fixed member 12 and an open top edge of the tank 4. The fixed member 12 is provided with a center hole that communicates to the storage tank 4 through the value device. A squeeze packing 13 is provided at the boundary between the inner wall face of the center hole and the valve seat 8.

A lead tube 14 is fixed at the front open part of the cylindrical shaft 1, for supplying hair dyeing liquid from the storage tank 4 to a coating part. The lead tube 14 penetrates the center hole of said fixed member 12 and its rear end reaches the interior of the spring seat 7 in connection with the valve stem 9.

The storage tank 4, valve device, squeeze packing 13 and the fixed member material 12 are freely movable with respect to the lead tube 14. The squeeze packing 13 always seals the outer periphery of the lead tube 14 preventing leaking of a hair dyeing liquid from the storage tank 4.

Figure 2:
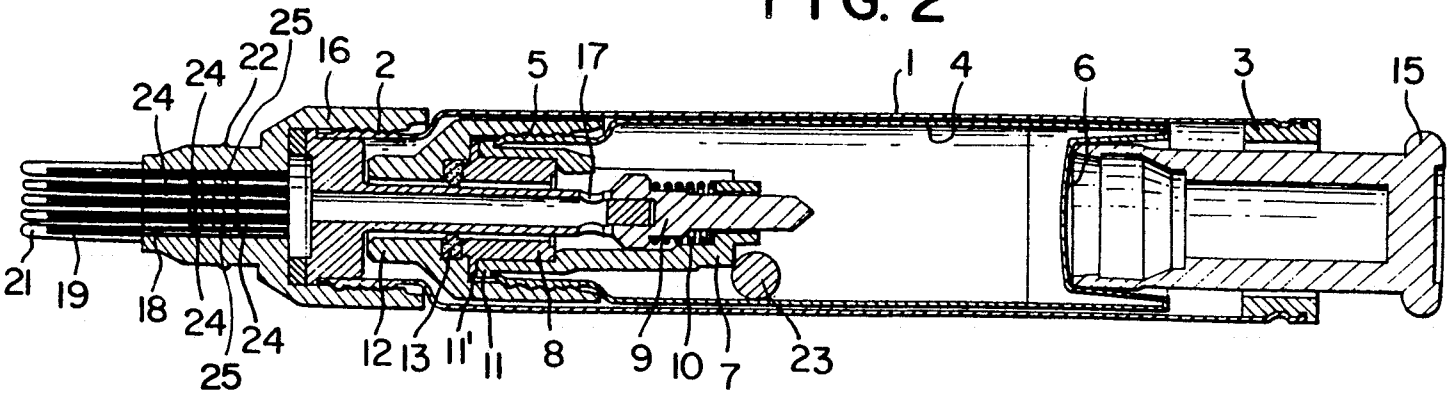
FIG. 2 is a longitudinal sectional view at the center, like FIg. 1, where the valve device of the hair dyeing tool of FIG. 1 is at an open position.
Figure 3:
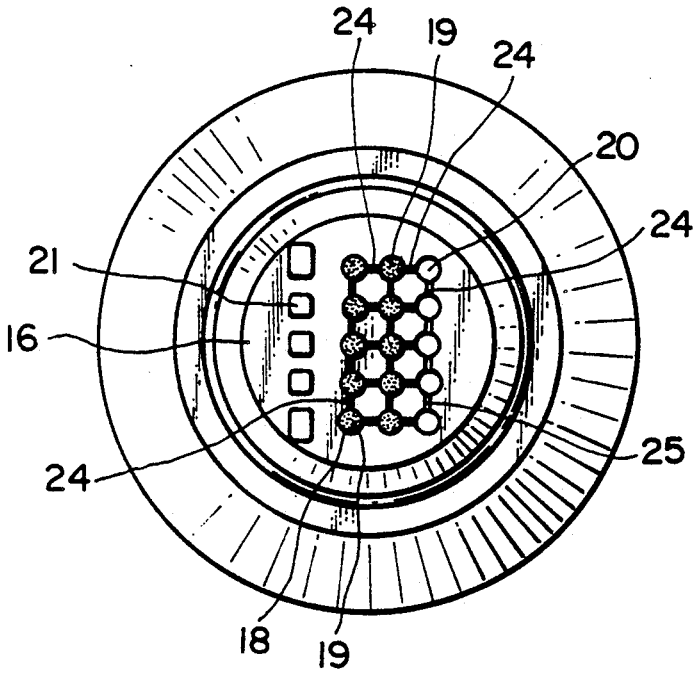
FIG. 3 is an expanded front view of the hair dyeing tool in the state of FIG. 2.

The valve device is opened when the storage tank 4 is advanced towards the lead tube 14 by an external force as shown in FIg. 2, as the valve stem 9 is pushed by the lead tube 14 while being separated from the valve set 8 overcoming the force of the valve spring 10. With the external force removed, the storage tank 4 is driven backwardly in relation to the lead tube 14 by the force of the valve spring 10, as shown in FIG. 1, thus the vale stem 9 is seated while closing the valve. When no external force is applied, the valve device maintains a closed state as shown in FIg. 1, by the function of the valve spring 10.

Forward driving of the storage tank 4, in order to open the valve, is as follows. A cap 15 is removed from the top member 16 and inserted into the cylindrical shaft 1 in such a manner to penetrate the rear tail plug 3 of the cylindrical shaft 1 engaging the top of the cap 15 in the rear recess 6. Thereafter, the cap 15 is pushed inwardly.

When the valve is opened, the storage tank 4 is communicated with the lead tube 14 through a lead-in hole 17 equipped at the rear end of the lead tube 14, thus supplying the hair dyeing liquid stored in the storage tank 4 to a coating portion through the lead-in hole 17 and lead tube 14.

The top part member 16, comprising a brush 19, a comb body 21 and small holes 20, is screwed onto the front end male threads 2 of the cylindrical shaft 1. Bristle root holes 18 of small diameter are drilled in two rows in a longitudinal direction substantially at the center portion of the top part member 16, and retain the brush 19 comprising fiber bundles embedded therein.

At the portion adjacent to the bristle root holes 18, small holes 20 are arranged parallel to the longitudinal direction of the bristle root holes 18 and conduct hair dyeing liquid or vent air. These bristle root holes 18 and small holes 20 are communicated with the lead tube 14.

Bristle root holes 18 and small holes 20 are communicated with each other laterally through slits 24. An object of the slits is to communicate the bristle root holes 18 with the small holes 20. Therefore, it is preferable that he depth of slits is as close to a total length of each hole as possible, provided no strength problem arises. Slits may also be interrupted by abridge 25 equipped at intermediate position axially of the member 16. In addition, bridges may be located at the upper and lower ends of each hole while using an intermediate part between the bridges as a slit.

A hair dyeing liquid, after passing through the lead tube 14, is supplied from bristle root holes 18 and small holes 20 to the root portion of the brush 19. The hair dyeing liquid, entering in small holes 20, also passes through the slits from small holes 20 and is absorbed also in bristle root holes 18. As a result, the supply of hair cosmetic to the brush is made extremely smooth. In addition, since the bristle root holes and the small holes are communicated together by means of slits, the rate of supplying of the hair dyeing liquid is made even to each brush bundle without irregularities, as a significant advantage.

A comb body 21 protrudes from the front end face of the top part member 16 in parallel with brush 19. The length of the comb body 21 is determined so that a top portion is slightly protruded from the top of the brush 19.

The protrusion of a comb body 21 as described can prevent the brush 19 from directly touch the skin of the person being treated. Inn addition, by positioning the comb body between the brush and the skin, it is to prevent direct contact of hair cosmetics from the brush adhere to the skin near the borders of hair since the comb body is equipped along the outer peripheral portion of the brush.

The teeth of the comb body 21 are separated from each other at the same intervals as those between each bundle of the brush 19, and also the same width as that of each bundle of the brush 19. It is preferred that the comb body 21 have a width at least as wide as the outer width of the brush 19.

The comb body 21 may preferably be removable, instead of being made integrally with the top part member 16.

When this coating to is not in use, the cap 15 is can cover the coating part comprising the brush 19 and the comb body 21, at the top of the coating tool as shown in FIG. 1. An elevated part 22 is provided on the outer periphery of the top part member 16 to hold the cap 15. When using the coating tool, this cap 15 is removed and inserted at the rear part of the cylindrical shaft 1 for using as a knocking member.

23 shows a ball for stirring the hair dyeing agent.

In the foregoing embodiment, a brush 19 is rooted in a part of the top part member 16 adjacent the small holes 20. However, an embodiment is also possible wherein the top part member comprises two pieces of a top shaft to be screwed in onto the cylindrical shaft 1 and a base provided with rooted brush and small holes 20. Even in such an embodiment, the bristle root holes and the small holes, provided in the base with each other are communicated with each other through slits. A comb body may be equipped either in the top shaft or on the base.

Furthermore, the present invention is applicable to a coating tool useful for not only a application of a temporary hair dyeing agent but also for application of a hair bleaching agent, permanent or semi-permanent hair dyeing agent, hair setting agent, permanent wave agent, hair treatment agent, etc. with the same functions and effects.

What is claimed is:

1. A hair cosmetics coating tool which comprises:

(a) a main cylindrical body;

(b) a cylindrical reservoir member for storing liquid hair cosmetic material and slidably mounted in said main body;

(c) an applicator head attached to said main body and having a plurality of brush tufts extending forwardly from said head and a plurality of comb teeth in a comb body also extending forwardly from said head adjacent to one side of said brush tufts for a distance beyond said brush tufts, each of said brush tufts being mounted in a bristle root hole in said applicator head;

(d) a supply means communicating from said reservoir member to said bristle root holes of said brush tufts to supply hair cosmetic liquid directly to said brush tufts;

(e) a valve device to control said supply mean having a knocking member mounted at the rear end of said main body;

(f) said applicator head having a plurality of axially extending liquid passages at least on a side of said brush tufts opposite said one side and transverse liquid passages on a forward face thereof extending between said axially extending liquid passages and said brush tufts, between said axially extending passages, and between said brush tufts to equalize flow of liquid to said tufts in said applicator head to ensure an adequate supply of liquid to said brush tufts;

whereby as the knocking member is depressed, the valve device is opened an liquid hair cosmetic is forced to flow to said brush tufts for application to hair of a user.

2. The hair cosmetics coating tool as set forth in claim 1, wherein said cylindrical reservoir member comprises a detachable cartridge.

3. The hair cosmetics coating tool as set forth in claim 1, wherein said comb body and said applicator head are detachable.

4. The hair cosmetics coating to as set forth in claim 1, wherein said brush tufts are separated from each other by an interval, and said plurality of comb teeth are separated from each other by a space equal to said interval.

* * * * *